US009669419B2

(12) United States Patent
Drozd et al.

(10) Patent No.: US 9,669,419 B2
(45) Date of Patent: Jun. 6, 2017

(54) SPRAY GUN HAVING PROTECTIVE LINER AND LIGHT TRIGGER PULL

(75) Inventors: Mitchell M. Drozd, Harwood Heights, IL (US); Paul R. Micheli, Glen Ellyn, IL (US); Christine S. Laub, Carol Stream, IL (US); Nekheel S. Gajjar, Chicago, IL (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 2344 days.

(21) Appl. No.: 12/613,372

(22) Filed: Nov. 5, 2009

(65) Prior Publication Data

US 2010/0108784 A1 May 6, 2010

Related U.S. Application Data

(60) Provisional application No. 61/111,723, filed on Nov. 5, 2008.

(51) Int. Cl.

*B05B 12/00* (2006.01)
*B05B 7/08* (2006.01)
*B05B 7/02* (2006.01)

(52) U.S. Cl.

CPC ..... *B05B 12/002* (2013.01); *B05B 7/0815* (2013.01); *B05B 7/02* (2013.01)

(58) Field of Classification Search

CPC ..... B05B 12/002; B05B 7/0815; B05B 7/02
USPC ..... 239/526, 263, 240, 380, 456, 501, 381, 239/263.3, 457, 458, 500, 541, 487, 465, 239/466, 464, 463, 237, 253, 251, 239/256–258, 252, 246–249, 263.1, 239/263.2, 452, 453, 222–224
See application file for complete search history.

(56) References Cited

U.S. PATENT DOCUMENTS

| | | | | | |
|---|---|---|---|---|---|
| 2,969,926 | A | * | 1/1961 | Peeps | 239/526 |
| 3,459,374 | A | | 8/1969 | Probst | |
| 3,559,891 | A | * | 2/1971 | Liedberg et al. | 239/443 |
| 3,780,953 | A | * | 12/1973 | Malec | 239/526 |
| 3,865,314 | A | * | 2/1975 | Levey et al. | 239/590.3 |
| 4,638,949 | A | * | 1/1987 | Mancel | 239/307 |
| 5,102,051 | A | * | 4/1992 | Smith et al. | 239/297 |
| 5,152,460 | A | * | 10/1992 | Barty | 239/290 |
| 5,183,207 | A | * | 2/1993 | Steinberg et al. | 239/526 |
| 5,267,693 | A | * | 12/1993 | Dickey | 239/417.3 |

(Continued)

FOREIGN PATENT DOCUMENTS

GB 1569736 6/1980

OTHER PUBLICATIONS

U.S. Appl. No. 12/119,133, filed May 12, 2008, Micheli.

(Continued)

*Primary Examiner* — Arthur O Hall
*Assistant Examiner* — Steven M Cernoch
(74) *Attorney, Agent, or Firm* — Fletcher Yoder, P.C.

(57) ABSTRACT

A spray coating system is provided with features to improve resistance to wear and corrosion, while also improving ergonomics. The spray coating system may include a spray coating device having a body with a liquid inlet coupled to a liquid chamber, and a protective liner extending inside the liquid chamber, wherein the protective liner is fixedly coupled to the body without threads. The spray coating device also may include a liquid nozzle extending inside the protective liner, and a cap extending over the liquid nozzle.

14 Claims, 8 Drawing Sheets

(56) References Cited

U.S. PATENT DOCUMENTS

| | | | | |
|---|---|---|---|---|
| 5,279,461 | A * | 1/1994 | Darroch | 239/297 |
| RE34,608 | E * | 5/1994 | Hufgard | 239/300 |
| 5,364,033 | A * | 11/1994 | Cedoz et al. | 239/526 |
| 5,732,886 | A * | 3/1998 | Liaw | 239/526 |
| 5,794,854 | A * | 8/1998 | Yie | 239/242 |
| 5,799,875 | A | 9/1998 | Weinstein et al. | |
| 6,808,122 | B2 | 10/2004 | Micheli | |
| 6,860,438 | B1 * | 3/2005 | Huang | 239/394 |
| 6,935,577 | B2 * | 8/2005 | Strong | 239/290 |
| 7,028,916 | B2 | 4/2006 | Micheli | |
| 7,150,415 | B2 * | 12/2006 | Weaver et al. | 239/443 |
| 7,201,336 | B2 * | 4/2007 | Blette et al. | 239/601 |
| 7,216,816 | B2 * | 5/2007 | Hammarth et al. | 239/106 |
| 7,237,726 | B2 * | 7/2007 | Yu | 239/290 |
| 7,296,759 | B2 * | 11/2007 | Alexander et al. | 239/296 |
| 7,311,271 | B2 | 12/2007 | Micheli | |
| 7,527,239 | B2 * | 5/2009 | Mau et al. | 251/121 |
| 7,568,635 | B2 | 8/2009 | Micheli | |
| 8,025,243 | B2 * | 9/2011 | Charpie | 239/332 |
| 8,066,205 | B2 * | 11/2011 | Bass et al. | 239/526 |
| 8,308,083 | B2 * | 11/2012 | Woodgate et al. | 239/297 |
| 2004/0046040 | A1 | 3/2004 | Micheli | |
| 2004/0050962 | A1 * | 3/2004 | Hammarth et al. | 239/302 |
| 2005/0145723 | A1 * | 7/2005 | Blette et al. | 239/525 |
| 2005/0145724 | A1 * | 7/2005 | Blette et al. | 239/525 |
| 2006/0000928 | A1 | 1/2006 | Micheli | |
| 2006/0202060 | A1 * | 9/2006 | Alexander | 239/525 |
| 2006/0214027 | A1 | 9/2006 | Micheli | |
| 2007/0221762 | A1 | 9/2007 | Micheli | |
| 2008/0017734 | A1 | 1/2008 | Micheli | |
| 2008/0048055 | A1 | 2/2008 | Micheli | |
| 2008/0295768 | A1 | 12/2008 | Micheli | |
| 2008/0296409 | A1 | 12/2008 | Micheli | |
| 2009/0148612 | A1 | 6/2009 | Micheli | |
| 2009/0224083 | A1 * | 9/2009 | Baltz | 239/692 |
| 2009/0230218 | A1 | 9/2009 | Drozd | |
| 2010/0108784 | A1 * | 5/2010 | Drozd et al. | 239/526 |
| 2011/0121103 | A1 * | 5/2011 | Carleton et al. | 239/337 |

OTHER PUBLICATIONS

U.S. Appl. No. 12/200,506, filed Aug. 28, 2008, Gajjar.
U.S. Appl. No. 12/541,346, filed Aug. 14, 2009, Micheli.
U.S. Appl. No. 12/561,259, filed Sep. 16, 2009, Micheli.

* cited by examiner

SPRAY GUN HAVING PROTECTIVE LINER AND LIGHT TRIGGER PULL

CROSS REFERENCE TO RELATED APPLICATION

This application claims priority to and the benefit of U.S. Provisional Patent Application Ser. No. 61/111,723, entitled "Spray Gun and Spray Gun Head for Air Cap and Fluid Nozzle Mounting," filed on Nov. 5, 2008, which is hereby incorporated by reference in its entirety.

BACKGROUND

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The invention relates generally to spray systems and, more particularly, to industrial spray coating systems for applying coatings of paint, stain, and the like. Specifically, the disclosed embodiments relate to a spray gun having unique features for improved durability, maintenance, and comfort of use.

Spray coating devices, e.g., paint spray guns, often thread components directly onto an aluminum body. After repeated assembly and disassembly of the components, threads on the aluminum body can become damaged or substantially worn, thereby causing problems with alignment, leakage, or performance of the entire spray gun. Existing spray guns also include many discrete components coupled together, e.g., spray head components, which can also cause problems with alignment, leakage, or performance. In addition, existing spray guns often route liquid and air passages directly through the aluminum body, i.e., in direct contact with aluminum. Unfortunately, the aluminum body is susceptible to wear and corrosion by many liquids, such as enamels, sealants, or water-based coatings. This wear and corrosion can cause plugging, leakage, and performance degradation of the spray gun. Existing spray guns also couple a valve trigger at a high pivot joint on the aluminum body (e.g., above all liquid and air passages), such that the pivot joint is a substantial distance away from valve abutment surfaces. Unfortunately, the high pivot joint can require a heavy trigger pull in order to operate the valves, and this heavy trigger pull can create user discomfort after a duration of operating the spray gun.

BRIEF DESCRIPTION

In one embodiment, a spray coating system is provided that generally includes, among other features, a spray coating device. The device includes a body, a liquid inlet coupled to a liquid chamber within the body, and a protective liner extending inside the liquid chamber. The protective liner is fixedly coupled to the body without threads and a liquid nozzle extends inside the protective liner. A cap extends over the liquid nozzle.

In another embodiment, a spray coating system is provided which generally includes, among other features, a spray gun trigger. The spray gun trigger is a one-piece structure having an integral cam surface configured to gradually convert rotation of the spray gun trigger into linear displacement of a needle valve. The trigger also includes a pivot joint disposed at an end portion of the one-piece structure at an offset from the integral cam surface, and the pivot joint is configured to couple the spray gun trigger to a body of a spray gun entirely on one side of an air passage.

In a further embodiment, a spray coating system is provided that includes, among other features, a spray gun head insert configured to fixedly mount inside a liquid chamber of a spray gun head without threads. The spray gun head insert includes a one-piece annular body and a first coupling disposed along an interior of the one-piece annular body. The first coupling is configured to mate with a first mating coupling of a liquid nozzle. The gun head insert also includes a second coupling disposed along an exterior of the one-piece annular body, wherein the second coupling is configured to mate with a second mating coupling of a cap.

Further, the gun head insert a valve packing receptacle configured to support a valve packing insert.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
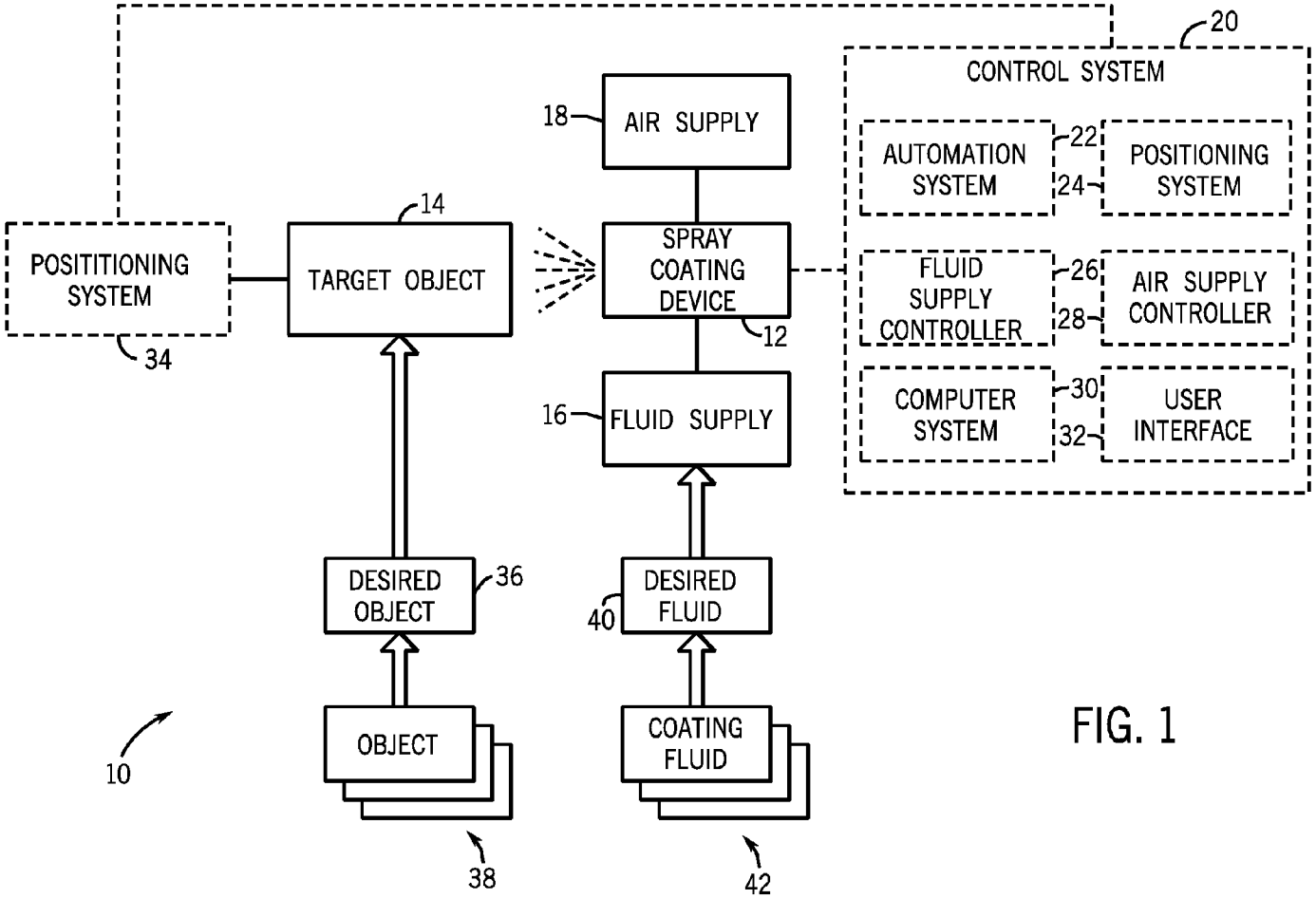
FIG. 1 is a diagram of an embodiment of a spray coating system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, the disclosed embodiments provide a spray coating device having, among other features, an improved trigger assembly and an improved head insert for air cap and fluid nozzle mounting. For example, the disclosed embodiments may include a protective liner or head insert fixedly coupled to a spray head of a spray coating device, such that the protectively liner completely covers an interior exposed to liquid flow. Thus, the protective liner may reduce or eliminate the possibility of erosion or corrosion of the base material of the spray head, which in turn increases the life of the spray coating device and reduces the possibility of particulate clogging the spray orifices. In certain embodiments, the protective liner may be made of stainless steel, a ceramic, a ceramic metal (i.e., cermet), or another wear resistant and corrosion resistant material. The protective insert may be fixedly coupled to the spray head without threads, for example, via a press fit connection. In addition, the disclosed embodiments may include a unique trigger assembly, which may include a light trigger pull and/or a short throw. For example, the trigger may have a pivot joint (e.g., rotational axis) located at a shorter distance relative to one or more fluid valves moved by the trigger, while also employing a cam surface provide sufficient valve displacement despite the shorter distance. The shorter distance may reduce the amount of force on the trigger to move the fluid valves, which improves ease of use and ergonomics of the spray coating device. The cam surface may be curved to control valve timing and displacement. These features, among others, substantially improve the performance and ergonomics of the spray coating device.

A spray coating device consistent with the present embodiments may be used in a variety of applications. For example, the illustrative spray gun may be used for corrosion protection applications, such as spray coating applications of enamel and zinc coatings for corrosion protection of metal parts and equipment such as oil rig structures on land, in the sea, and similar environments which may benefit from resistive coatings. Additionally or alternatively, the illustrative spray coating device may be used in general metal fabricating applications, such as small, medium and large metal fabricating shops of all types. In certain of these embodiments, the spray coating device may be used to coat store fixtures, welded metal parts and structures, and sheet metal fabrications. These fabricating shops may utilize, for example, water based and solvent (organic) based coating materials ranging from very low to high viscosity. The spray coating device, in certain aspects, may be used in other applications, such as in the wood and wood particle laminate manufacturing industry. Typically, water and/or solvent based contact cements and adhesives are sprayed to facilitate the bonding of pieces of solid wood or wood layers onto different substrates.

FIG. 1 is a flow chart of an exemplary spray coating system 10, which includes a spray coating device 12 for applying a desired coating to a target object 14. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. Accordingly, the spray coating system 10 may provide a computer-controlled mixture of coating fluid, fluid and air flow rates, and spray pattern. Moreover, the positioning system 34 may include a robotic arm controlled by the control system 20, such that the spray coating device 12 covers the entire surface of the target object 14 in a uniform and efficient manner.

The spray coating system 10 of FIG. 1 is applicable to a wide variety of applications, fluids, target objects, and types/configurations of the spray coating device 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray coating device 12 may also include a variety of different components and spray formation mechanisms to accommodate the target object 14 and fluid supply 16 selected by the user. For example, the spray coating device 12 may utilize an air atomizer, a rotary atomizer, an electrostatic atomizer, or any other suitable spray formation mechanism.

Figure 2:
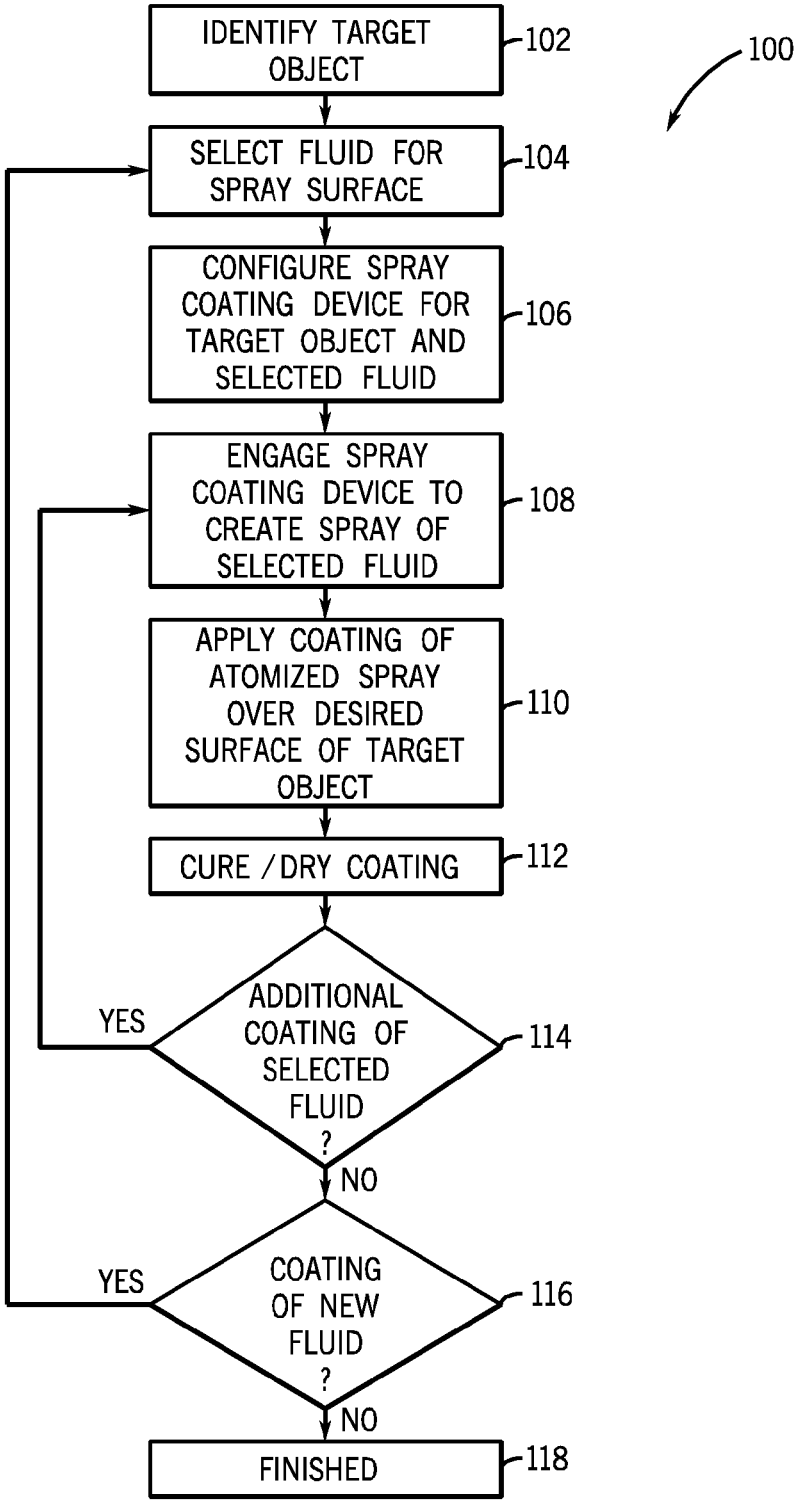
FIG. 2 is a flow chart of an embodiment of a spray coating process.

FIG. 2 is a flow chart of an embodiment of a spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, the process 100 then proceeds through blocks 104-114 using a new selected fluid for the spray coating. If the user does not desire a coating of a new fluid at query block 116, then the process 100 is finished at block 118.

Figure 3:
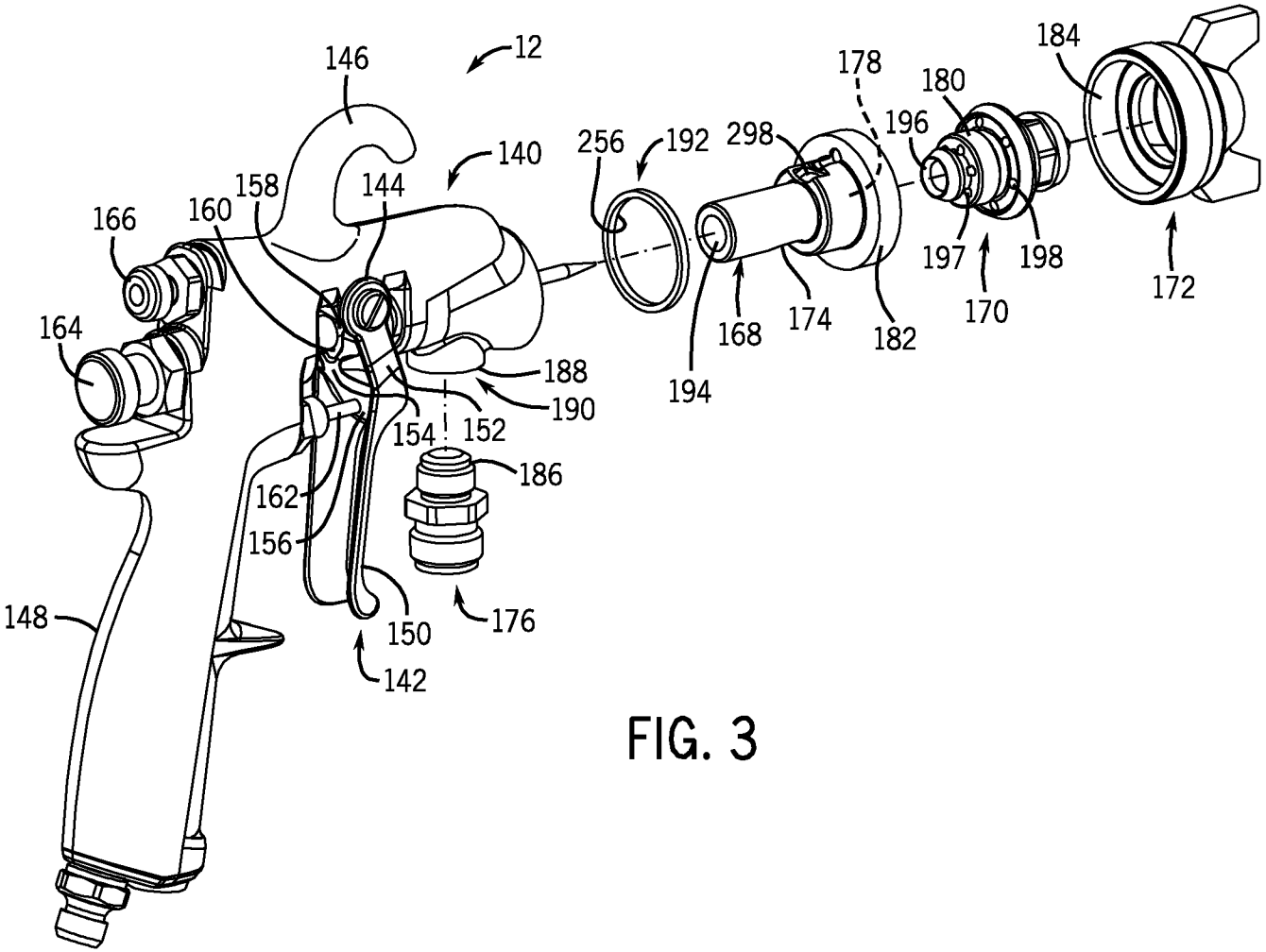
FIG. 3 is a rear perspective exploded view of an embodiment of a spray coating device used in the spray coating system and method of FIGS. 1 and 2.

FIG. 3 is a rear perspective exploded view of an embodiment of the spray coating device 12 used in the system and method of FIGS. 1 and 2. As illustrated, the spray coating device 12 is a spray gun, though it should be appreciated that the present system and techniques may apply to any number of spray coating devices that utilize similar components. As depicted, the spray coating device 12 includes a device body 140 to which a trigger assembly 142 is attached via a pivot joint 144. The device body 140 according to present embodiments also includes a hook 146 for hanging and/or storing the coating device 12 when not in use and an ergonomic handle 148 designed to increase operator comfort during use. The device body 140 may be constructed from a relatively durable and lightweight material (e.g., metal or plastic) such that an operator does not experience increased fatigue due to heavy equipment. For example, the device body 140 may be made of aluminum (e.g., an aluminum alloy). As a result, the device 12 may, when fully assembled, weigh between approximately 10 to 35, 15 to 30, 20 to 25, or 23 to 24 ounces (e.g., 23.3 ounces).

According to one aspect, the trigger assembly 142 is cast as a one-piece structure that includes a trigger handle 150 and a trigger lever 152. The trigger lever 152 may include, among other features, a liquid valve biasing surface 154 and an air valve biasing surface 156. In the illustrated embodiment, the liquid valve biasing surface 154 is a curved surface (e.g., a cam surface) that is integrally cast with the trigger assembly 142. As discussed in further detail below, the curved liquid valve biasing surface 154 (e.g., cam surface) is configured to control the timing and magnitude of valve displacement in response to a trigger pull on the trigger assembly 142. The air valve biasing surface 156 is depicted as a flat surface that is also integral with the trigger assembly 142, though the air valve biasing surface may be curved in other configurations.

The trigger assembly 142 is further configured to enable travel of a liquid needle valve 158 that extends movably through the device body 140 along a position disposed proximate the cam surface 154, such that when the trigger handle 150 is depressed by an operator, the liquid needle valve 158 initially rests along a groove 160 and is, at a pre-determined time relative to the travel of an air valve 162, positionally biased by the cam surface 154. That is, during operation of the coating device 12, the cam surface 154 controls the timing and magnitude of the flow of liquid through the coating device 12 by gradually converting rotation of the trigger handle 150 into linear displacement of the liquid needle valve 158. As the trigger 150 is gradually pulled from a first position (e.g., rest position) to a second position (e.g., actuated position), the cam surface 154 gradually engages and moves the liquid needle valve 158 with a timing and magnitude based on the curvature of the cam surface 154. In other words, if the cam surface 154 has a large slope or rapidly increasing slope, then the cam surface 154 may quickly increase the displacement of the liquid needle valve 158. In contrast, if the cam surface 154 has a small slope or slowly increasing slope, then the cam surface 154 may slowly increase the displacement of the liquid needle valve 158. Given that the cam surface 154 is different than the air valve biasing surface 158, the cam surface 154 may control timing of the liquid flow relative to the air flow.

In certain embodiments, the trigger assembly 142 is generally configured such that air begins to flow through the coating device body 140 before any liquid is released. For example, based on the configuration of the cam surface 154, the liquid needle valve 158 may not be displaced until the trigger handle 150 has been sufficiently pulled to allow the cam surface 150 to abut the liquid needle valve 158. In contrast, the air valve biasing surface 156 may be configured such that any rotation of the trigger handle 150 during operation results substantially simultaneously in displacement of the air valve 162. As a result of the air flow actuation prior to the liquid flow actuation, the trigger assembly 142 may function to provide a pre-spray air purge of the coating device 12, thereby removing any remaining residues from within the device 12 prior to liquid flow and spray formation. Accordingly, upon depression of the trigger handle 150, the air valve biasing surface 156 causes the air valve 162 to displace, and air begins to flow through the device 12. This is followed by abutment and biasing of the liquid needle valve 158 by the cam surface 154 resulting in liquid flow. Of course, the greater the depression of the trigger handle 150, the greater the travel by valves 158, 160 and thus, greater total fluid flow. To this end, the illustrated coating device 12 also includes features configured to adjust the flow of liquid and air through the coating device 12. These features may generally include a liquid valve adjustment knob 164 and an air valve adjustment knob 166, which are configured to at least partially adjust the rate of flow of their respective media through the device body 140 and out through the head of the coating device 12.

Further illustrated as exploded away from the device body 140 are a head insert 168 configured to be fixedly secured to the device body 140, and a fluid nozzle 170 and air cap 172 configured to be removably secured to the head insert 168. The head insert 168 may be designed such that its shape affords a manufacturer the ability to fixedly mount the head insert 168 to the device body 140, which ultimately results in a reduced amount of required maintenance and a reduced risk of cross-threading and deterioration due to assembly-disassembly by an end-user. For example, the head insert 168 may have a generally annular structure, which may be inserted into an annular interior surface of the device body 140 (e.g., a liquid chamber) without threads. In one embodiment, the annular structure may be press fit (or interference fit) into the annular interior surface, such that it fixed in place by frictional forces without use of threads. In another embodiment, the annular structure may be adhesively secured to the annular interior surface using an adhesive (e.g., LOCKTITE). In another embodiment, the annular structure may be shrink fit into the annular interior surface, e.g., by heating the device body 140 and/or cooling the head insert 168 prior to insertion of the head insert 168. The shrink fit may occur as the parts return to room temperature.

The annular structure of the head insert 168 may include a first coupling (e.g., internal threads 178) disposed along an interior surface for removably securing to a first mating coupling (e.g., external threads 180) of the fluid nozzle 170, and a second coupling (e.g., external threads 182) disposed along an external surface for securing to a second mating coupling (e.g., internal threads 184) of the air cap 172.

The coupling of both the fluid nozzle 170 and the air cap 172 to the head insert 168 (i.e., single structure) provides several advantages, including a reduced possibility of misalignment of any removable parts at the head of the coating device 12. In other words, rather than directly threading onto the device body 140 and/or multiple distinct parts, the fluid nozzle 170 and the air cap 172 both thread onto the common head insert 168. As a result, the fluid nozzle 170 threads onto the common head insert 168 in alignment with a longitudinal axis 256, while the air cap 172 also threads onto the common head insert 168 in alignment with the longitudinal axis 256.

The threading is also improved in the disclosed embodiment. Although the device body 140 may be made of a light weight and/or soft material (e.g., aluminum), the head insert 168, the fluid nozzle 170, and the air cap 172 may be made of a hard material (e.g., stainless steel). The greater hardness of the head insert 168 reduces the possibility of cross-threading, thread damage, or misalignment associated with threading directly onto the device body 140. Thus, the threading occurs between two hard materials (e.g., stainless steel) rather than one hard material (e.g., stainless steel) and one soft material (e.g. aluminum). Although the illustrated embodiment employs threads between the head insert 168, the fluid nozzle 170, and the air cap 172, certain embodiments of the couplings may include snap fittings or other fasteners in addition to or instead of threads.

The illustrated head insert 168 also includes a liquid opening 174 and an air opening 298 configured to route liquid and air to the fluid nozzle 170. As illustrated, the head insert 168 is configured to receive liquid through the opening 174 from a liquid inlet fitting 176, and the head insert 168 is configured to receive air through the air opening 298 from an air passage in the device body 140. In turn, the head insert 168 directs the liquid into an internal liquid passage 196 of the fluid nozzle 170, and directs the air into a first plurality of air passages 197 and a second plurality of air passages 198 in the fluid nozzle 170. These passages 196, 197, and 198 direct liquid and air from the fluid nozzle 170 to the air cap 170, which in turn generates a liquid spray.

The liquid inlet fitting 176 includes male threads 186 configured to couple with female threads 188 of a liquid inlet 190 in the device body 140. As the liquid inlet fitting 176 threads into the liquid inlet 190, the fitting 176 abuts against liquid opening 174 in the head insert 168 to create a liquid seal. Thus, the head insert 168 and the fitting 176 collectively line the interior surface of the device body 140. For example, the head insert 168 and the fitting 176 may completely line the entire interior surface of the device body 140 in the vicinity of the liquid flow, thereby completely isolating the liquid flow from the material of the device body 140. As discussed below, the head insert 168 and the fitting 176 may be made of a protective material (e.g., wear resistant and corrosion resistant) to reduce wear and corrosion by the liquid being sprayed by the coating device 12. In addition, the coating device 12 includes an annular seal 192 between the device body 140 and the head insert 168. The annular seal 192 blocks liquid leakage from an interior 194 of the head insert 168 and/or the fluid nozzle 170 to the device body 140.

In existing coating systems, components may become degraded over time for a variety of reasons. For example, accidental droppage, normal wear over time, corrosion, and the assembly and disassembly processes associated with cleaning may degrade various components, resulting in a non-functional coating device. In contrast, the head insert 168 according to present embodiments has a one-piece design that is constructed from materials exhibiting increased resistance to these and other processes. For example, the device body 140 may be constructed from a first material and the head insert 168 (and the fitting 176) may be constructed from a second material with a greater hardness, greater chemical resistance, and/or greater wear resistance. In certain of these embodiments, the second material has a wear resistance, a hardness, and/or a chemical resistance, or any combination thereof, that is at least approximately 1.1 to 20, 1.5 to 10, or 2 to 5 times greater than the first material. In one embodiment, the second material has a wear resistance, a hardness, and/or a chemical resistance, or any combination thereof, that is at least approximately 10, 20, 30, 40, 50, 60, 70, 80, 90, 100, 150, 200, 250, or 300, 350, or 400 percent greater than the first material. In a further embodiment, the first material may be an aluminum alloy (about 95 on Brinell hardness scale) or a brass alloy (about 144 on Brinell hardness scale) and the second material may be a stainless steel material (e.g., 303 stainless steel, about 262 on Brinell hardness scale), tungsten carbide, a ceramic, or a ceramic metal (i.e., a cermet).

As mentioned, the head insert 168 may be, in some embodiments, fixedly secured to the device body 140 in an area where liquid (e.g., a coating liquid) may be staged for dispersal. Indeed, in certain embodiments, the device 12 may be configured such that the head insert 168 acts as a liquid receptacle, for example, a receptacle for liquid entering into the device 12 from a liquid inlet fitting 176. Thus, the liquid inlet fitting 176 and head insert 168 may be constructed from similar or the same materials, for example steel, such that any liquid within the device 12 may be isolated from the first material (the material of the device body 140) by the second material (the material of the head insert 168 and the liquid inlet fitting 176). Thus, in certain embodiments, the head insert 168 may be a protective liner and the liquid inlet fitting 176 may be a protective fitting.

Figure 4:
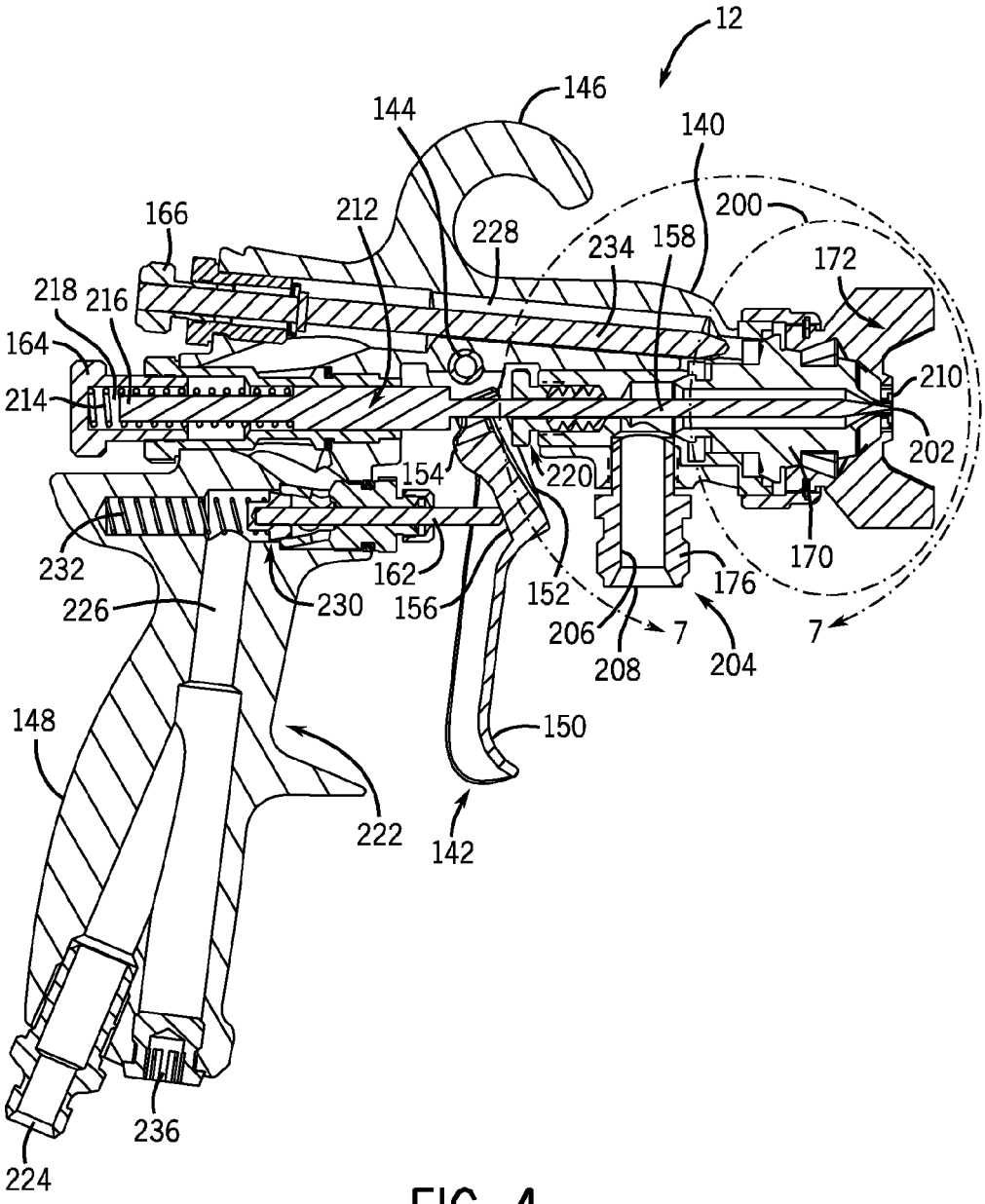
FIG. 4 is a cross-sectional side view of an embodiment of the spray coating device of FIG. 3, illustrating a first position (e.g., rest position) of a trigger and associated fluid valves.

FIG. 4 is a cross-sectional side view illustrating an embodiment of the spray coating device 12 depicted in FIG. 3. As illustrated, the spray coating device 12 includes, among other features, a spray tip assembly 200 coupled to the device body 140. The spray tip assembly 200 includes the aforementioned head insert 168, fluid nozzle 170, and air cap 172 in a fully assembled configuration. As mentioned, a number of different types of spray coating devices may benefit from the present configurations, where a one-piece, durable head insert 168 is employed such that various fluid nozzles and air caps may be removably secured to allow an operator maximum flexibility when choosing a coating. The air cap 172 includes one or more air atomization orifices disposed about a liquid tip exit 202. The air cap 172 may also include one or more spray shaping air orifices, which employ air jets to force the sprayed fluid to form a desired spray pattern (e.g., a non-conical pattern). The air cap 172 also may include a variety of other atomization mechanisms to provide a desired spray pattern and droplet distribution.

The body 140 of the spray coating device 12 includes a variety of controls and supply mechanisms for the spray tip assembly 200. As illustrated, the body 140 includes a fluid delivery assembly 204 that includes the liquid inlet fitting 176 having a liquid passage 206 extending from a liquid inlet coupling 208 to a fluid delivery tip assembly 210. As mentioned, the liquid passage 206 may be lined with a material (e.g., steel) that has a chemical resistance, wear resistance, and hardness that is greater than the bulk material from which the device body 140 is constructed (e.g., an aluminum or brass alloy). The fluid delivery assembly 204 also includes a liquid valve assembly 212 that is configured to control liquid flow through the liquid passage 206 and to the fluid delivery tip assembly 210. The illustrated liquid valve assembly 212 includes the needle valve 158 which, as mentioned, extends movably through the body 140 between the fluid delivery tip assembly 210 and the liquid valve adjustment knob 164. The liquid valve adjustment knob 164 is rotatably adjustable against a liquid needle valve biasing spring 214 disposed between a rear section 216 of the liquid needle valve 158 and an internal portion 218 of the liquid valve adjustment knob 164. The liquid needle valve 158 is coupled to the trigger assembly 142 via the cam surface 154, such that the liquid needle valve 158 may be moved inwardly away from the spray tip assembly 200 as the trigger assembly 142 is rotated in a rearward direction about the pivot joint 144. The liquid valve assembly 212 also may include a variety of packing and seal assemblies, such as packing assembly 220, disposed between the liquid needle valve 158 and the device body 140. In some embodiments, the packing assembly 220 may be constructed from a plastic (e.g., polytetrafluoroethylene).

An air supply assembly 222 is also disposed in the device body 140 to facilitate air flow through the device 12. The illustrated air supply assembly 222 extends from an air inlet coupling 224 to the air cap 172 via air passages 226 and 228. The air supply assembly 222 also includes a variety of seal assemblies, air valve assemblies, and air valve adjusters to maintain and regulate the air pressure and flow through the spray coating device 12. For example, the illustrated air supply assembly 222 includes an air valve assembly 230 coupled to the trigger assembly 142, such that rearward rotation of the trigger assembly 142 about the pivot joint 144 opens the air valve assembly 230 by displacement of the air valve 162 against an air valve biasing spring 232 to allow air flow from the air passage 226 to the air passage 228. The air supply assembly 222 also includes the air valve adjustment knob 166 coupled to a needle 234, such that the needle 234 is movable via rotation of the air valve adjustment knob 166 to regulate the air flow to the air cap 172. In situations where it may be desirable to coarse adjust the air flow through the device 12 (e.g., when connected to a fixed pressure outlet), a coarse air flow adjustment valve 236 (e.g., a cheater valve) is provided such that an operator may adjust the maximum air flow rate through the device 12. In some embodiments, the volumetric air flow in cubic feet per minute (cfm) at 40 pounds per square inch pressure (psi) may be between approximately 5 to 40, 10 to 30, 10 to 20, or 15 to 25 cfm. The variable volumetric air flow may depend on the particular configuration of the device 12 such as, for example, the particular setting of the air valve adjustment knob 166 and the setting of the cheater valve 236.

Figure 5:
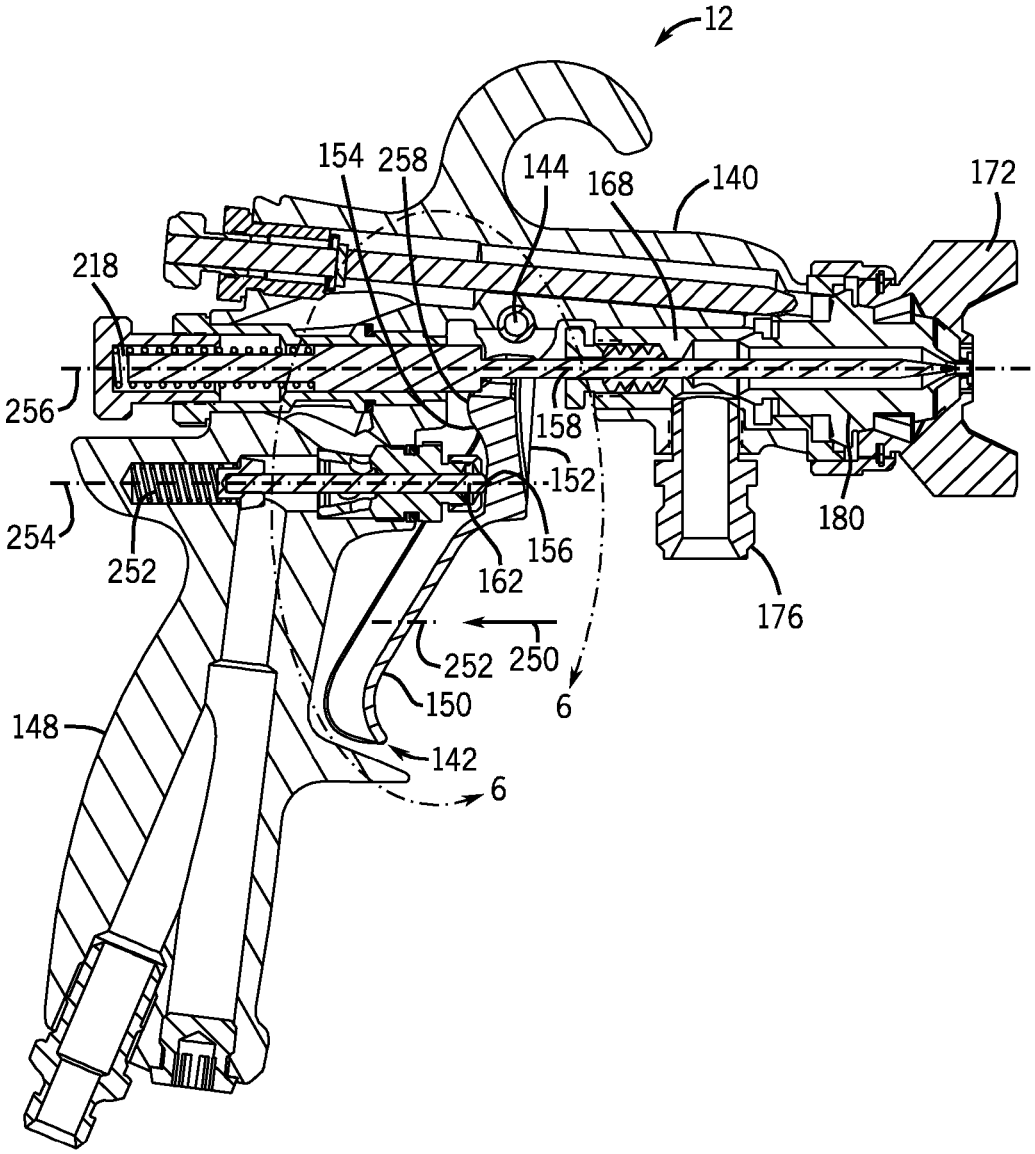
FIG. 5 is a cross-sectional side view of an embodiment of the spray coating device of FIG. 3, illustrating a second position (e.g., actuated position) of a trigger and associated fluid valves.

As mentioned above, the one-piece trigger assembly 142 is coupled to both the liquid valve assembly 212 and the air valve assembly 230, such that liquid and air controllably flow to the spray tip assembly 200 as the trigger handle 150 is pulled in a rearward direction toward the handle 148 of the device body 140 via rotation about the pivot joint 144. Once engaged, the spray coating device 12 produces an atomized spray with a desired spray pattern (e.g., non-conical) and droplet distribution. Moving now to FIG. 5, a cross-section of the device 12 is illustrated wherein the trigger handle 150 has been depressed by a force 250. In the depicted embodiment, the force 250 is applied at a center point 252 on the trigger handle 150, which results in biasing of the air valve 162 followed by biasing of the liquid needle valve 158 due to rotation of the trigger lever 152. In the illustrated embodiment, upon providing the force 250, the air valve biasing surface 156 serves to linearly displace the air valve 162 along an air valve central axis 254 in a rearward direction towards the device handle 148. As a result, the air valve biasing spring 232 is compressed, resulting in stored potential energy that serves to restore the air valve 162 to its original position once the force 250 has been removed. In a similar fashion, the force 250 that results in rotation of the trigger lever 152 also causes the cam surface 154 to linearly displace the liquid needle valve 158 along a liquid needle valve central axis 256. As discussed below, the curved geometry of the cam surface 154 provides a non-linear relationship between trigger pull on the trigger handle 150 and linear displacement of the liquid needle valve 158. In other words, a ratio of linear displacement of the liquid needle valve 158 versus trigger pull of the trigger handle 150 may be variable, e.g., gradually increasing according to the variable slope of the cam surface 154. For example, if the slope of the cam surface 154 rapidly increases, then the linear displacement of the liquid needle valve 158 would rapidly increase in response to trigger pull on the trigger handle 150. As appreciated, the curvature (e.g., variable slope) of the cam surface 154 may be designed to control the amount of linear displacement of the liquid needle valve 158 relative to the degree of trigger pull on the trigger handle 150, and thus also relative to the linear displacement of the air valve 162. Thus, the curvature of the cam surface 154 may control timing of displacement (e.g., a ratio of valve displacements) between the air valve 162 and the liquid needle valve 158.

Figure 8:
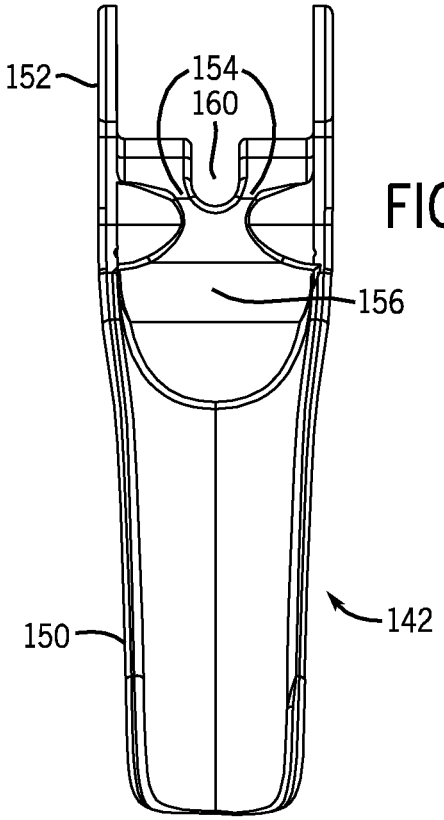
FIG. 8 is a rear view of an embodiment of a one-piece trigger of a spray coating device as shown in FIGS. 3-7.
Figure 9:
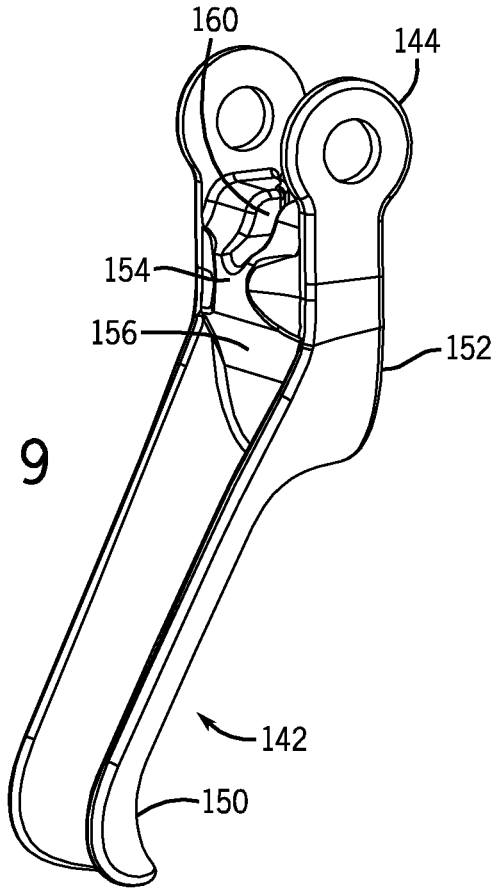
FIG. 9 is a rear perspective view of an embodiment of a one-piece trigger of a spray coating device as shown in FIGS. 3-8.

As mentioned, at rest, the liquid needle valve 158 rests within the groove 160 (FIGS. 3, 8, and 9). However, when the force 250 is applied, the rotation of the trigger lever 152 causes abutment of the liquid needle valve 158 with the cam surface 154. Due to the curved nature of the cam surface 154, the liquid needle valve 158 is gradually biased to a point of maximum displacement, represented in the illustrated embodiment as a cam surface apex 258. As may be appreciated, the trigger assembly 152 may be configured such that when the force 250 results in maximum pull of the trigger handle 150, the liquid needle valve 158 is abutted by the cam surface apex 258, resulting in maximum linear displacement. As with the displacement of the air valve 162, the linear displacement of the liquid needle valve 158 towards the device handle 148 results in compression of the liquid needle valve biasing spring 214, such that when the force 250 is removed, the potential energy stored by the compressed spring 214 may return the liquid needle valve 158 to its original position. The force 250 that is required to depress the trigger handle 150 may vary based upon a number of factors including the design of the trigger assembly 142, the tension in springs 214, 232, and the dynamic air pressure within the device 12. Indeed, the configuration of the trigger assembly 142 according to present embodiments may allow an operator to use the spray coating device 12 with relative ease and thus, for longer periods of time and with a decreased risk of injury (e.g., risk of carpal tunnel syndrome). In particular, the trigger assembly 142 is designed with a light trigger pull and/or short throw based on the low positioning of the pivot joint 144 (e.g., shorter distance between pivot joint 144 and valves 158 and 162).

Figure 6:
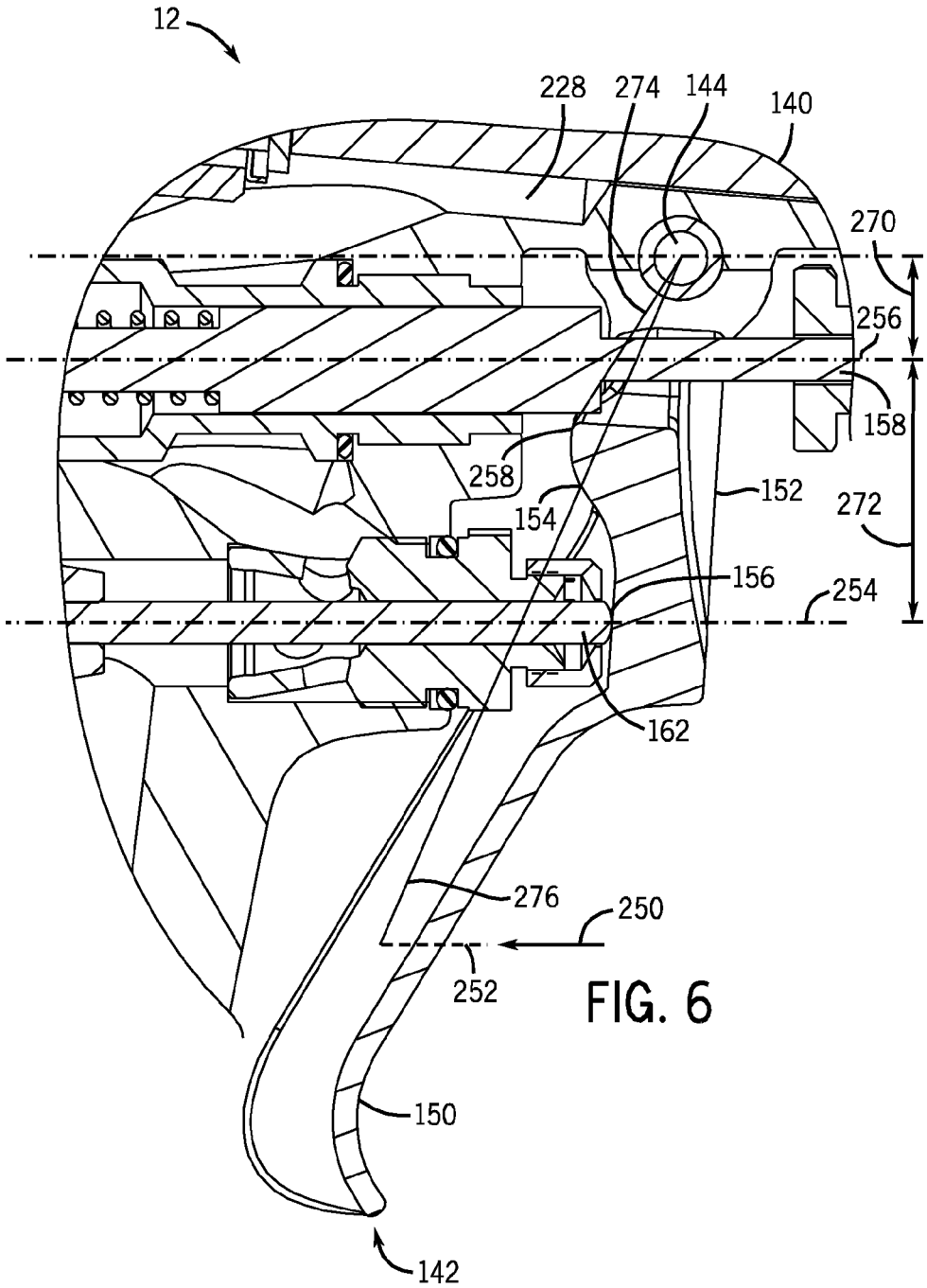
FIG. 6 is a partial cross-sectional side view of an embodiment of a trigger and fluid valves of a spray coating device taken within arcuate line 6-6 of FIG. 5.

As mentioned, the trigger assembly 142 according to the present technique may result in a number of advantages and improvements over other trigger assemblies employed in conventional spray coating devices. Accordingly, FIG. 6 is a partial cross-section within arcuate line 6-6 of FIG. 5, further illustrating the configuration of the trigger assembly 142 according to an embodiment of the present technique. Among other features, FIG. 6 depicts the one-piece trigger assembly 142 having the pivot joint 144, the trigger handle 150, and the trigger lever 152 all disposed on one common side of the air passage 228. as illustrated, the one-piece trigger assembly 142 includes the trigger lever 152 extending from the trigger handle 150, and the trigger lever 152 includes a first valve biasing surface (the cam surface 154) and a second valve biasing surface (the air valve biasing surface 156). In the illustrated embodiment, the pivot joint 144 is disposed below the air passage 228 in close proximity to the liquid needle valve 158 and the air valve 162, thereby substantially reducing the distance between the pivot joint 144 and the surfaces 154 and 156 as compared with a pivot joint disposed above the air passage 228. Likewise, the liquid needle valve 158 and the air valve 162 are also disposed below the air passage 228, such that the pivot joint 144, the trigger handle 150, the trigger lever 152, the liquid needle valve 158, and the air valve 162 are all disposed on one common side of the air passage 228 (i.e., below). As discussed in further detail below, this low position of the pivot joint 144 substantially reduces a requisite trigger pull force on the trigger handle 150 to induce valve displacement of the valves 158 and 162. In other words, the low position of the pivot joint 144 results in a light trigger pull, which may be at least approximately 5, 10, 15, 20, 25, 50, 75, or 100 percent less than a high position of the pivot joint 144

(i.e., above the air passage 228). The low position of the pivot joint 144 in combination with the cam surface 154 also may result in a short throw of the trigger 144, e.g., less pull displacement of the trigger handle 150 to actuate the valves 158 and 162.

In the illustrated embodiment, the pivot joint 144 is disposed at a first perpendicular offset 270 from the liquid needle valve central axis 256 along which the cam surface 154 positionally displaces the liquid needle valve 158. Similarly, the pivot joint 144 is disposed along a second perpendicular offset 272 from the air valve central axis 254 along which the air valve biasing surface 156 displaces the air valve 162. In certain embodiments, the second perpendicular offset 272 is at least approximately 2 times greater than the first perpendicular offset 270. For example, the second perpendicular offset 272 may range between approximately 2 to 5 or 3 to 4 times greater than the first perpendicular offset 270 (e.g., approximately 2, 2.5, 3, 3.1, 3.2, 3.3, 3.4, 3.5 or 4 times greater). Similarly, the cam surface apex 258 and the trigger handle center point 252 are at a first offset 274 and a second offset 276, respectively, from the center of the pivot joint 144. In certain embodiments, the second offset 276 may be greater than the first offset 274 by a factor between approximately 1.5 to 5 times. For example, the second offset 276 may be at least approximately 1.5, 2, 2.5, 3, 3.1, 3.2, 3.3, 3.4, 3.5, 4, 4.5, or 5 times greater than the first offset 274.

By configuring the trigger assembly 142 with such dimensions, the requisite force 250 to depress the trigger handle 150 may be lowered when compared to the dimensions in conventional trigger assembly configurations. That is, the requisite force 250 may be substantially reduced due to a combination of lowering the fulcrum point of the trigger assembly 142 (the pivot joint 144) below the air passage 228 and the relative distances between the pivot joint 144, the cam surface apex 258, and the trigger handle center point 252, among other parts of the coating device 12. Thus, the trigger assembly 142 may employ a reduced force 250 that allows an operator to use the spray coating device 12 for extended periods of time and with minimal discomfort. In some embodiments, the requisite force 250 to depress the trigger handle 150 to actuate the valves 158 and 162 may range between approximately 2.5 to 7.5, 2.5 to 5, or 4.5 to 5 lbs., or at least less than approximately 4 or 5 lbs. For example, in one embodiment, the requisite force 250 to depress the trigger handle 150 at 40 psi dynamic air pressure may be approximately 4.5 lbs. In another embodiment, the requisite force 250 to depress the trigger handle 150 at both 60 psi and 80 psi may be approximately 5 lbs.

Figure 7:
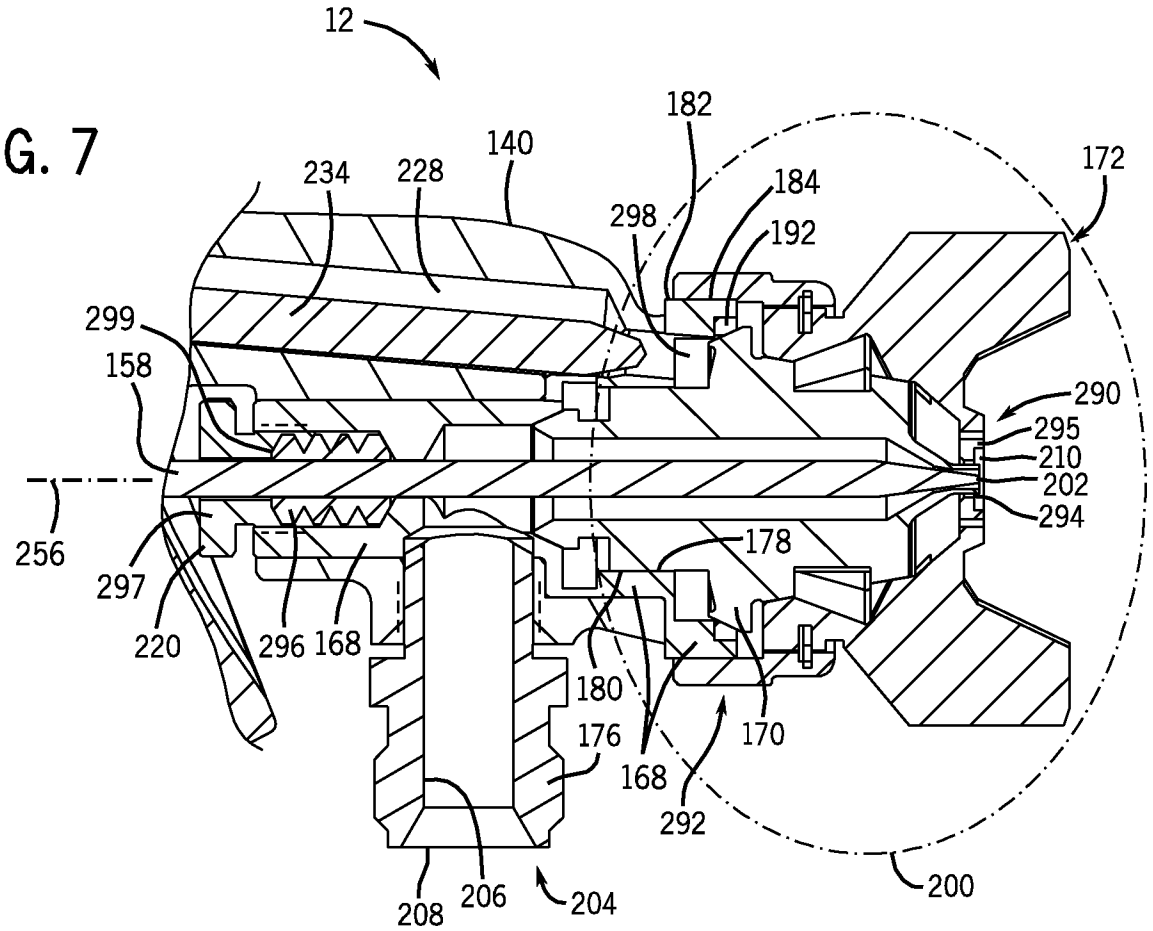
FIG. 7 is a partial cross-sectional side view of an embodiment of a head of a spray coating device taken within arcuate line 7-7 of FIG. 4.

FIG. 7 is a partial cross-sectional view taken within arcuate line 7-7 of FIG. 4, illustrating details of the spray tip assembly 200 and the fluid delivery assembly 204. The spray tip assembly 200 includes a spray formation assembly 290 coupled to the fluid delivery tip assembly 210. The spray formation assembly 290 includes the air cap 172, which is removably secured to the head insert 168 via a retaining nut 292. The retaining nut 292 includes the female threads 184, which thread onto the male threads 182 on the head insert 168. The air cap 172 includes a variety of air orifices 294 and 295 at different distances relative to the axis 256. For example, the air orifice 294 may be an annular shaped air orifice disposed in close proximately about the liquid tip exit 202 of the fluid delivery tip assembly 210, whereas the air orifice 294 may include a plurality of air orifices in a circumferentially spaced arrangement at a greater distance from the axis 256. These air orifices 294 and 296 may be configured to atomize and shape a liquid exiting the liquid tip exit 202.

The fluid delivery assembly 204 includes the liquid fitting insert 176 and the liquid passage 206, which extends from the liquid inlet coupling 208 to the fluid delivery tip assembly 210. As mentioned, the head insert 168 and the liquid inlet fitting 176 may both act as a protective liner and fitting, respectively, such that the device body 140 is not degraded due to exposure of the device body material to any liquid coating materials flowing through the device 12. Further depicted in FIG. 7 is the packing assembly 220, which is disposed between the liquid needle valve 158 and the head insert 168. In the illustrated embodiment, the packing assembly 220 includes a packing 296 (e.g., elastomeric and/or rubber packing) and a threaded body 297 (e.g., external threads) coupled to internal threads 299 of the head insert 168. The threaded body 297 axially compresses the packing 296, thereby causing radial expansion and thus a sealed interface between the liquid needle valve 158 and the head insert 168. The illustrated packing assembly 220 threads directly into the head insert 168, rather than threading into the device body 140. As discussed above, the head insert 168 may be made from a hard, wear resistant, and corrosion resistant material (e.g., stainless steel), whereas the device body 140 may be made of a soft, wear susceptible, corrosion susceptible material (e.g., aluminum). The one-piece construction of the head insert 168 provides threads 178, 182, and 299 for directly coupling with the fluid nozzle 170, the air cap 172, and the packing assembly 220, thereby reducing the possibility of thread damage, misalignment, and leakage.

In the illustrated embodiment, the one-piece construction of the head insert 168 integrates threaded couplings and also passages for liquid flow, atomizing air flow, and fan pattern air flow. Accordingly, the head insert 168 may also include an inlet 298 which connects fluidly with the air passage 228. While using the spray coating device 12, an operator may extend or retract the air needle 234 as another level of adjustment of the air flowing to the air cap 172 for atomization purposes. Thus, the one-piece construction of the head insert 168 assures concentric consistency in aligning the liquid needle valve 158, the fluid nozzle 170, the air passage 228, and the air cap 172.

Moving now to FIGS. 8 and 9, a close-up rear view and a rear-perspective view, respectively, of the one-piece trigger assembly 142 are depicted. The trigger assembly 142 includes the trigger handle 150 and the trigger lever 152, which includes the liquid valve biasing surface (the cam surface 154), the air valve biasing surface 156, and the recessed groove 160 along which the liquid needle valve 158 rests. During operation of the coating device 12, the liquid needle valve 158 engages and moves along the cam surface 154, while the air valve 162 engages and moves along air valve biasing surface 156. As mentioned, the one-piece trigger assembly 142 controls the timing and valve displacement of the liquid needle valve 158 and the air valve 162 at least partially based on the curvature of the cam surface 154 versus the geometry (e.g., flat) of the air valve biasing surface 156, and also the distance of the pivot joint 144 relative to the surfaces 154 and 156. For example, as mentioned above, the cam surface 154 may have a curvature configured to time the valve opening of the air valve 162 prior to the liquid needle valve 158, and to vary the displacement of the liquid needle valve 158 according to an equation (e.g., a polynomial equation) representing the curvature of the cam surface 154. Indeed, in certain aspects, it may be desirable to vary (1) the timing between these valve displacements, and (2) the ratio of needle valve 158 displacement versus air valve 162 displacement to control the degree of atomization, droplet size distribution, spray shaping, internal liquid breakup, and other aspects of spray generation. In some embodiments, the timing and relative valve displacements may be controller by varying the curvature of the cam surface 154 in relation to the flat air valve biasing surface 156.

In certain embodiments, the polynomial equation defining the curvature of the cam surface 154 may be a first, second, third, fourth, fifth, sixth, seventh, eighth, ninth, tenth, or greater degree polynomial equation. In certain embodiments, the cam surface 152 may be represented by the following equation:

$$y=A_{n+7}*x^{n+7}+A_{n+6}*x^{n+6}+A_{n+5}*x^{n+5}+A_{n+4}*x^{n+4}+A_{n+3}*x^{n+3}+A_{n+2}*x^{n+2}+A_{n+1}*x^{n+1}+A_n*x^n+A_0 \quad (1)$$

In certain embodiments of equation (1) above, n=1, $A_n$ is a constant ranging between −200 and 250, and $A_0$ is a constant ranging between −1000 and 1000. In one specific embodiment, the curvature of the cam surface 152 may be represented by the following sixth-degree polynomial equation:

$$y=-87.35*x^6+211.13*x^5-178.56*x^4+60.517*x^3-6.880*x^2+0.4032*x-0.0017. \quad (2)$$

Again, the particular curvature of the cam surface 154 may vary between implementations, liquids, and other factors. However, the foregoing equations (1) and (2) represent exemplary embodiments of the cam surface 154 in combination with the low positioning of the pivot joint 144 (e.g., below the air passage 228).

In certain embodiments, the trigger assembly 142 integrates wear resistant materials along the biasing surfaces 154 and 156 to reduce the wear associated with the engagement and movement between the valves 158 and 162 and their biasing surfaces 154 and 156. In some embodiments, the trigger assembly 142 may be made with a wear resistant coating over a core material, or it may be made entirely with a wear resistant material. For example, the trigger assembly 142 may be a zinc die cast or a carbon steel cast with a zinc plating. By further example, the trigger assembly 142 may be made with stainless steel.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A spray coating system, comprising:

a spray coating device, comprising:

a body comprising a liquid inlet coupled to a liquid chamber;

a protective liner extending inside the liquid chamber, wherein the protective liner is a one-piece annular body fixedly coupled to the body without threads, wherein the one-piece annular body has a first and second couplings, the first coupling is disposed along an interior of the protective liner and a second coupling is disposed along an exterior of the protective liner;

a liquid nozzle extending inside the protective liner, wherein the liquid nozzle comprises a first mating coupling that couples with the first coupling of the protective liner; and a cap extending over the liquid nozzle, wherein the cap comprises a second mating coupling that couples with the second coupling of the protective liner.

2. The spray coating system of claim 1, wherein the body is made of a first material and the protective liner is made of a second material, wherein the second material has a wear resistance, a hardness, a chemical resistance, or a combination thereof, that is greater than the first material.

3. The spray coating system of claim 1, wherein the body consists essentially of aluminum and the protective liner consists essentially of steel.

4. The spray coating system of claim 1, wherein the liquid chamber comprises an annular interior surface, and the one-piece annular body of the protective liner is press fit into the annular interior surface.

5. The spray coating system of claim 1, wherein the first coupling comprises first female threads, the first mating coupling comprises first male threads, the second coupling comprises second male threads, and the second mating coupling comprises second female threads.

6. The spray coating system of claim 5, comprising a valve packing insert extending inside the protective liner, wherein a needle valve extends through the valve packing insert and into the liquid nozzle.

7. The spray coating system of claim 5, comprising a protective fitting extending into the liquid inlet against the protective liner, wherein the body is made of a first material, the protective liner is made of a second material, the protective fitting is made of a third material, wherein the second and third materials are different than the first material, wherein the protective liner and the protective fitting define a liquid path to the liquid nozzle, and the liquid path is isolated from the first material of the body.

8. The spray coating system of claim 1, comprising a valve trigger coupled to the body at a pivot joint, wherein the valve trigger and the pivot joint are entirely on one side of an air passage extending through the body.

9. The spray coating system of claim 1, wherein a valve trigger coupled to the body at a pivot joint, wherein the valve trigger comprises an integral cam surface, and the integral cam surface is configured to gradually convert rotation of the valve trigger into linear displacement of a needle valve extending through the protective liner.

10. The spray coating system of claim 1, wherein the protective liner is a spray gun head insert configured to fixedly mount inside the liquid chamber of a spray gun head without threads.

11. The spray coating system of claim 1, comprising:

a spray gun trigger coupled to the spray coating device, wherein the spray gun trigger has a one-piece structure, comprising:

a trigger handle;

a trigger lever extending from the trigger handle, wherein the trigger lever comprises a first valve biasing surface configured to displace a first valve member, and the first valve biasing surface comprises an integral cam surface configured to gradually convert rotation of the spray gun trigger into linear displacement of the first valve member; and a pivot joint disposed at an end portion of the trigger lever opposite from the trigger handle, wherein the pivot joint is disposed at an offset from the integral cam surface, and the pivot joint couples the spray gun trigger to a body of the spray coating device entirely on one side of an air passage.

12. The spray coating system of claim 11, wherein:

the trigger lever comprises a second valve biasing surface configured to displace a second valve member;

the integral cam surface is configured to control displacement timing of the first valve member relative to the second valve member; and the first valve biasing surface is configured to bias the first valve member along a first axis of the first valve member at a first perpendicular offset from the pivot joint, the second valve biasing surface is configured to bias the second valve member along a second axis of the second valve member at a second perpendicular offset from the pivot joint, and second perpendicular offset is at least approximately 2.5 times greater than the first perpendicular offset.

13. The spray coating system of claim 11, wherein the first valve biasing surface has a peak displacement point along the integral cam surface at a first offset from the pivot joint, the trigger handle has a center point at a second offset from the pivot joint, and the second offset is at least approximately 2.5 times greater than the first offset.

14. The spray coating system of claim 11, wherein the first valve and the spray gun trigger are both positioned on the one side of the air passage, the body consists essentially of aluminum or an aluminum alloy, and the spray gun trigger consists essentially of steel.

* * * * *